United States Patent [19]

Asami et al.

[11] Patent Number: 4,830,582

[45] Date of Patent: May 16, 1989

[54] ROTARY TYPE COMPRESSING APPARATUS EMPLOYING EXHAUST GAS CONTROL VALVE

[75] Inventors: Kazutomo Asami; Hidehiko Yamada; Nobuhiro Shimizu, all of Shizuoka, Japan

[73] Assignee: Mitsubishi Denki Kabushiki Kaisha, Tokyo, Japan

[21] Appl. No.: 77,923

[22] Filed: Jul. 27, 1987

[30] Foreign Application Priority Data

Aug. 4, 1986 [JP] Japan ..... 61-183014

[51] Int. Cl.[4] ..... F04B 39/00

[52] U.S. Cl. ..... 417/312; 417/458

[58] Field of Search ..... 417/312, 313, 458, 902; 62/296; 418/181

[56] References Cited

U.S. PATENT DOCUMENTS

| | | | |
|---|---|---|---|
| 359,948 | 3/1887 | Wilson | 137/508 X |
| 694,811 | 3/1902 | Whiting | 137/508 |
| 2,136,098 | 11/1938 | Browne | 417/312 X |
| 2,804,881 | 9/1957 | Seid et al. | 137/508 X |
| 4,135,602 | 1/1979 | Clark | 417/312 X |
| 4,199,306 | 4/1980 | Hughes | 417/458 |
| 4,277,955 | 7/1981 | Parker | 417/902 X |
| 4,373,872 | 2/1983 | Kemmer et al. | 417/312 |
| 4,522,038 | 6/1985 | Ozu | 417/299 |

FOREIGN PATENT DOCUMENTS

| | | | |
|---|---|---|---|
| 188429 | 3/1956 | Austria | 417/458 |
| 238643 | 8/1986 | German Democratic Rep. | 417/312 |
| 58-87988 | 6/1983 | Japan . | |
| 58-211587 | 12/1983 | Japan . | |
| 60-204986 | 6/1985 | Japan . | |
| 60-153482 | 8/1985 | Japan | 417/371 |

*Primary Examiner*—Carlton R. Croyle
*Assistant Examiner*—Leonard P. Walnoha
*Attorney, Agent, or Firm*—Armstrong, Nikaido, Marmelstein, Kubovcik & Murray

[57] ABSTRACT

In a rotary type compressing apparatus, a check valve is positioned in a refrigerant gas inhalation unit, and an exhaust valve is positioned in a refrigerant gas exhaust unit. In addition, a control valve is employed at an inlet section of an exhaust pipe. One end of this exhaust pipe is opened inside a muffler which forms airtight space within a closed case. This control valve is actuated by means of a slider valve body by receiving specific pressure.

3 Claims, 3 Drawing Sheets

ROTARY TYPE COMPRESSING APPARATUS EMPLOYING EXHAUST GAS CONTROL VALVE

BACKGROUND OF THE INVENTION

1. Field of the Invention

The present invention relates to a rotary type compressing apparatus employed in a refrigerant circuit of a cryogenic refrigerator or air conditioning apparatus.

2. Description of the Prior Art

A cryogenic refrigerant apparatus including a rotary compressor is widely known in the art, for instance, from Japanese patent disclosure No. 60-204986. Referring now to FIG. 1, there is provided a refrigerant circuit employing a rotary compressor as disclosed in the above-described Japanese patent disclosure. In the circuit diagram of FIG. 1, a rotary compressor 1 is connected to a condenser 2 which is in turn connected to a control valve 3. The control valve 3 is connected via a capillary tube 4 to an evaporator 5. The evaporator 5 is connected via a check valve 6 to the rotary compressor 1. As is known in the art, these members are connected by refrigerant circuits in series flow relation with the above-defined order. Accordingly, a refrigerant gas is circulated as indicated by arrows, within the closed loop of the cryogenic refrigerant circuit for performing heat exchange.

To improve the above-described conventional refrigerant circuit, another rotary refrigerant compressor, as shown in FIG. 2, is proposed in the above patent disclosure. Referring to FIG. 2, a closed case 7 encompasses a compression element 8, an electrically-powered drive element 9, an jetting pipe 10, and a control valve 3. This compressor is positioned in a refrigerant circuit similar to FIG. 1 for heat exchange.

In the refrigerant circuit as illustrated in FIG. 1, the control valve 3 is controlled in such a way that it is opened during the operation of the compressor 1, whereas it is closed after the compressor 1 is stopped, thereby enabling the refrigerant circuit to be opened and closed. As a result, the control valve 3 can prevent the high-pressure refrigerant located in the condenser 2 and the closed case 7 of the compressor 1 from flowing into the evaporator 5 at a low-pressure and a low temperature through the capillary tube 4 after the compressor 1 is stopped. Since the temperature increases in the evaporator 5 due to the flow of the refrigerant therein is suppressed, the duty cycle of the compressor 1 can be maintained low so that the efficiency of the refrigerant circuit is increased. The function of the check valve 6 is as follows. As the refrigerant flows in the normal direction during the operation of the compressor 1, this valve is opened, whereas it is closed by a pressure difference between the evaporator 5 and the closed case 7 of the compressor 1 after the latter is stopped. Accordingly, this check valve 6 can block the refrigerant at the high-pressure and high temperature conditions that tends to flow into the evaporator 5. FIG. 2 shows a rotary refrigerant compressor in which similar valve controlling is effected by a check valve 6 and a control valve 3 provided. That is to say, during the operation of the compressor 1, the exhaust gas fed into a muffler from the compressor mechanism is exhausted via the jetting pipe 10 into the closed case 7. In this case, as previously described, the control valve 3 mounted on the tip of the jetting pipe 00 is opened and closed by a pressure difference between the exhaust gas in the jetting pipe 10 and the gas in the closed case 7. Simultaneously, this control valve 3 is adapted to open and close a communication hole 12 between the closed case 7 and an exhaust pipe 11, so that the gas present in the closed case 7 is supplied via the exhaust pipe 11 to the refrigerant circuit. Since the above-described pressure difference is no longer present after the compressor 1 has been interrupted, the control valve 3 is closed, whereby the communication hole 12 between the exhaust pipe 11 and the closed case 7 is in the closed condition. As a result, the flow of the high-pressure refrigerant present in the closed case 7 into the evaporator 5 is blocked.

On the other hand, the check valve 6 located in the inhaling path has a substantially same check-valve mechanism as the check valve shown in FIG. 1, and is mounted in the closed case 7. The function of the check valve 6 is to prevent the high-pressure refrigerant in the closed case 7 from flowing into the evaporator 5 via the inhaling path when the compressor 1 is stopped, which is similar to the function of the check valve shown in FIG. 1.

With the above-described construction, the conventional rotary compressor has, however, several drawbacks. Since the high-pressure and high-temperature gas exhausted from the compressor into the muffler 13 is once released via the jetting pipe 10 into the closed case 7, the heat radiation from the exhausted gas may be induced in the closed case 7. Such heat radiation causes the overall temperature of the compressor to considerably increase, resulting in a lower working efficiency of the compressor.

The present invention is made in consideration of the above-described problems in the conventional rotary compressing apparatus.

An object of the invention is to provide a rotary compressing apparatus wherein after the rotary compressing apparatus is stopped, a lower efficiency of the refrigerant unit, or refrigerant circuit due to equilibrium in the pressure of the refrigerant can be avoided.

Another object of the present invention is to provide a rotary compressing apparatus wherein a working efficiency thereof can also be prevented from decreasing by blocking the heat radiation from the exhausted gas.

Still another object of the present invention is to provide a low-cost rotary compressing apparatus.

SUMMARY OF THE INVENTION

The basic idea of the present invention will now be summarized.

In a rotary compressing apparatus, a check valve is positioned in a gas inhalation unit, and an exhaust valve is positioned in a gas exhaust unit. In addition, a control valve is employed at an inlet section of an exhaust pipe. One end of this exhaust pipe is opened inside a muffler which forms airtight space within a closed case. This valve is of a slider valve and its control is effected by the pressure difference between the internal pressure of the muffler and the resultant force of a spring force and the internal pressure of the closed case.

Aforementioned objects and features of the present invention are accomplished by providing a rotary type compressing apparatus wherein a rolling piston type compression element and an electrically-powered drive element for driving the compression element are mounted in a closed case constructed of a high-pressure vessel, characterized in that a check valve is provided in a refrigerant gas inhalation path of the compressing apparatus, and there are provided in a gas exhaust path of the compressing apparatus;

an exhaust valve positioned at an outlet of the compression element;

a muffler for forming airtight space which covers said exhaust valve;

an exhaust pipe having one end opened to an inside of said muffler; and a control valve positioned at an inlet, or intermediate section of the exhaust pipe, capable of being opened and closed in said muffler.

BRIEF DESCRIPTION OF THE DRAWINGS

For a better understanding of these and other objects of the present invention, reference is made to the following detailed description of the invention to be read in conjunction with the following drawings, in which.

DETAILED DESCRIPTION OF THE PREFERRED EMBODIMENTS

Construction of Rotary Compressor

Figure 3:
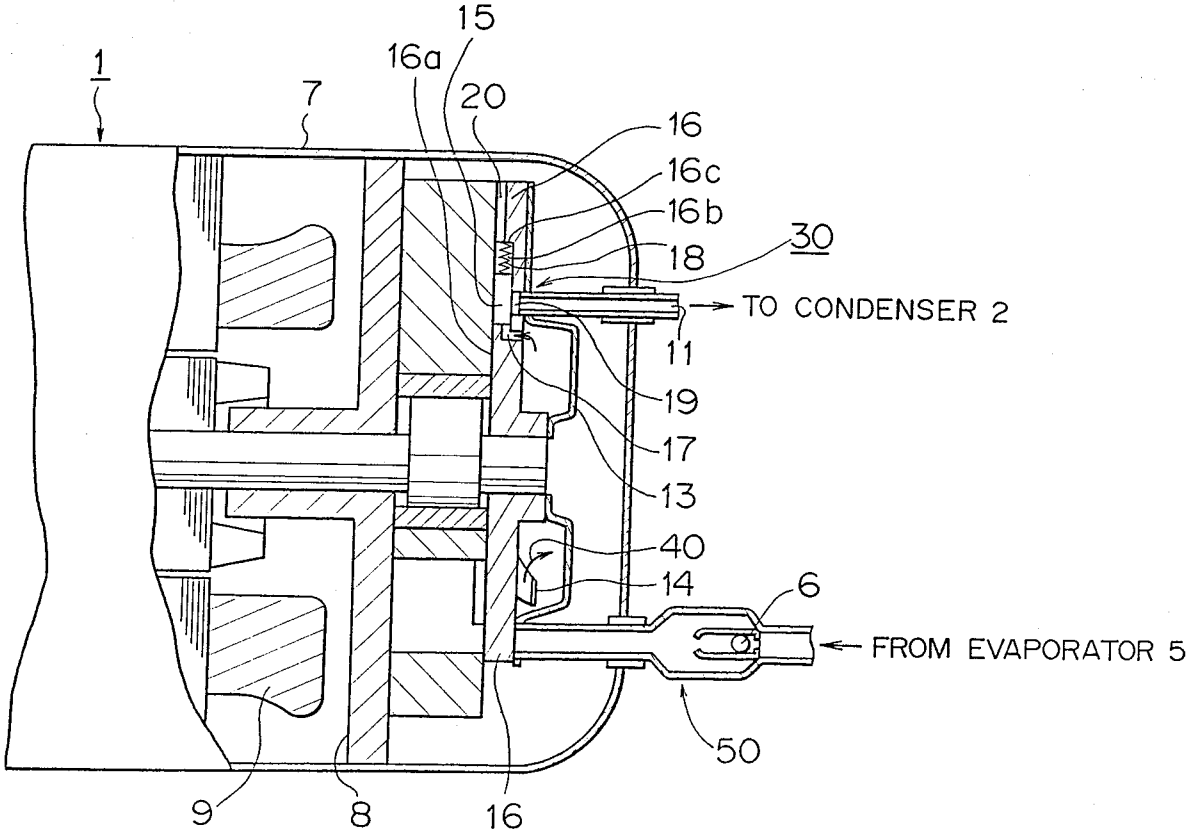
FIG. 3 is a sectional view of the major part of a rotary compressor according to one preferred embodiment of the invention.

Referring now to FIG. 3, there is shown a fragmentary sectional view of a rotary compressor according to one preferred embodiment of the invention.

Figure 1:
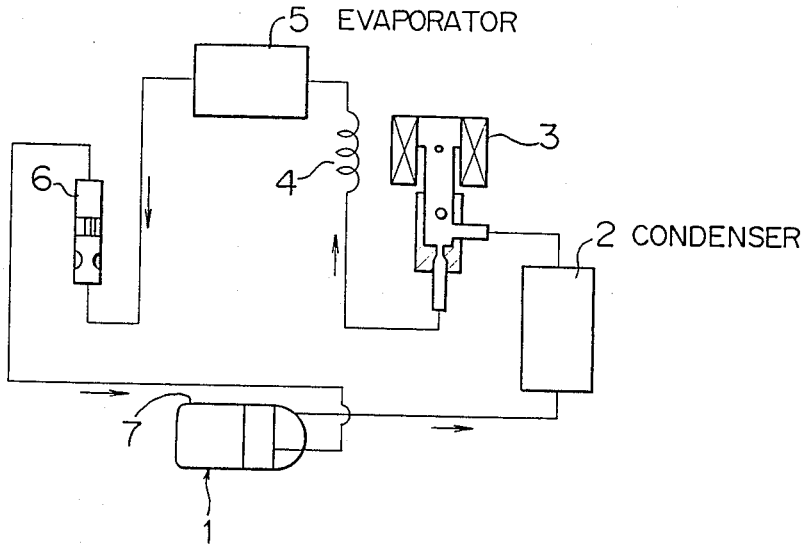
FIG. 1 Prior Art
FIG. 1 is a schematic diagram of the conventional refrigerant circuit employing the rotary compressor.
Figure 2:
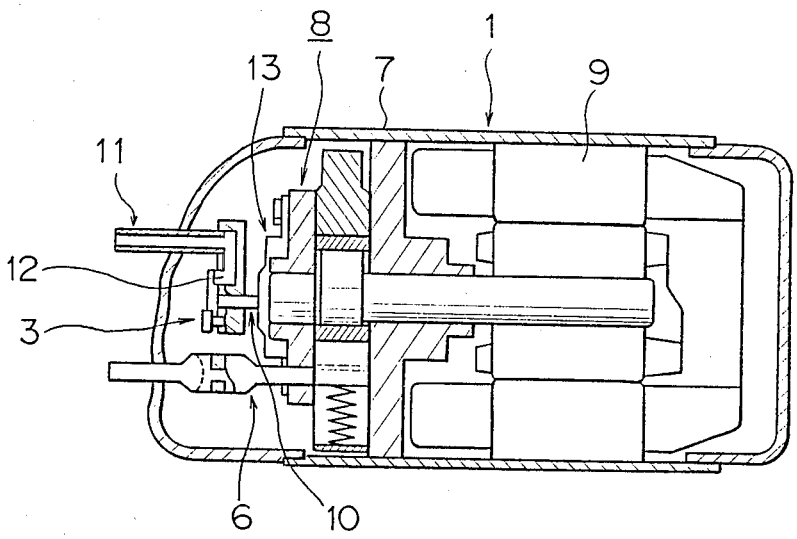
FIG. 2 Prior Art
FIG. 2 is a partially sectional view of the conventional rotary compressor.

It should be noted that the same reference numerals shown in FIGS. 1 and 2 will be employed as those for denoting the same elements shown in FIG. 3.

The rotary compressor 1 as illustrated in FIG. 3 employs the closed case 7. The closed case 7 contains the compression element 8, electrically-powered drive element 9, an exhaust valve 14 disposed on a part of the compressor mechanism, and a muffler 13 made of a sheet metal, for covering the exhaust valve 14.

The exhaust valve 14 is opened or closed by the pressure difference between the internal pressure of the muffler 13 and the pressure in the cylinder.

When the valve 14 is opened, the exhaust gas is exhausted from the cylinder into the muffler. And when the valve is closed, the reverse flow of the gas in the muffler into the cylinder is blocked.

One end of the exhaust pipe 11 is directly connected to the refrigerant circuit outside the closed case 7, and the other end thereof is opened to this sheet metal muffler 13 via a part of thrust bearing 16 of the compression element 8. Then, a control valve 30 is positioned adjacent an opening 17. This control valve 30 is constructed by a slider valve body 15 of a substantially rectangular solid; a space **16-*b* for receiving the valve body 15, recessed from the surface 16-*a* on cylinder side of the thrust bearing 16; and a spring 18 for urging the valve body 15. The above-described space 16-*b* includes a hole 17 communicated with the inside of the muffler 13; another hole 19 communicated with the exhaust pipe 11 at the surface opposite to the surface 16-*a* of the thrust bearing 16; and a groove 20 which opens to the surface of a seat 16-*c* of the spring 18 and communicates with the closed case 7**.

When the rotary compressor 1 is started, the high-pressure and high-temperature gas that has been compressed by means of the compression elèment 8 first causes the exhaust valve 14 to open as shown by an arrow 40 and is exhausted into the inside of the muffler 13.

Thereafter, most of the exhaust gas is exhausted into the communication hole 17, and reaches the one end of the valve body 15 opposite to the spring 18, though a small amount of the exhaust gas may leak into the inside of the closed case 7 through the sealed part of the sheet metal muffler 13 secured to the compression element 8.

Under the present condition, the valve body 15 is moved toward the spring 18 within the space **16-*b*, when the valve body 15 is pushed by the internal pressure force of the pressure in the closed case 7 and the force of the spring 18**.

Accordingly, the communication hole 19 which has always been closed is now opened with respect to the space **16-*b*, so that the exhaust pipe 11 is communicated with the inside of the muffler 13, which enables the gas inside the muffler 13 to be exhausted via the exhaust pipe 11** into the refrigerant circuit.

The pressure in the closed case 7 is at a level intermediate the pressure of the refrigerant returning through the check valve 6 on the inlet side of the compressor and the pressure of the refrigerant exiting through the exhaust pipe 11. The pressure of the refrigerant gas internally of the closed case 7 and external of the muffler 7 is not charged to any particular level but rather results from leakage through other parts such as the sheet metal muffler 13 or other moving parts of the compressor.

Stoppage of Rotary Compressor

When the rotary compressor halts and the supply of the high pressure gas is blocked, the resultant force of the pressure in the closed case 7 and the force of spring 8 overcomes the internal pressure of muffler 13 and causes the valve body 15 to move away from the spring 8 thus closing the communication hole 19 mentioned above. And therefore the control valve 30 according to the present invention can block the flow of the refrigerant gas into the circuit when the compressor halts. Thus the pressure and temperature within the circuit are retarded their rates of increase toward equilibrium.

It is obvious that since the check valve 6 mounted in the inlet side can prevent the gas and oil from reversely flowing through the inhale path, the heat invasion to the evaporator 5 can be suppressed considerably.

Moreover, most of the gas exhausted from the compression element 8 is directed to the exhaust pipe 11 via the muffler 13.

Accordingly, the overall temperature of the compressor 1 can be maintained sufficiently low and this low temperature can improve not only the efficiency in inhalation and compression of the gas, driving efficiency of the motor, but also life time and reliability.

Figure 4:
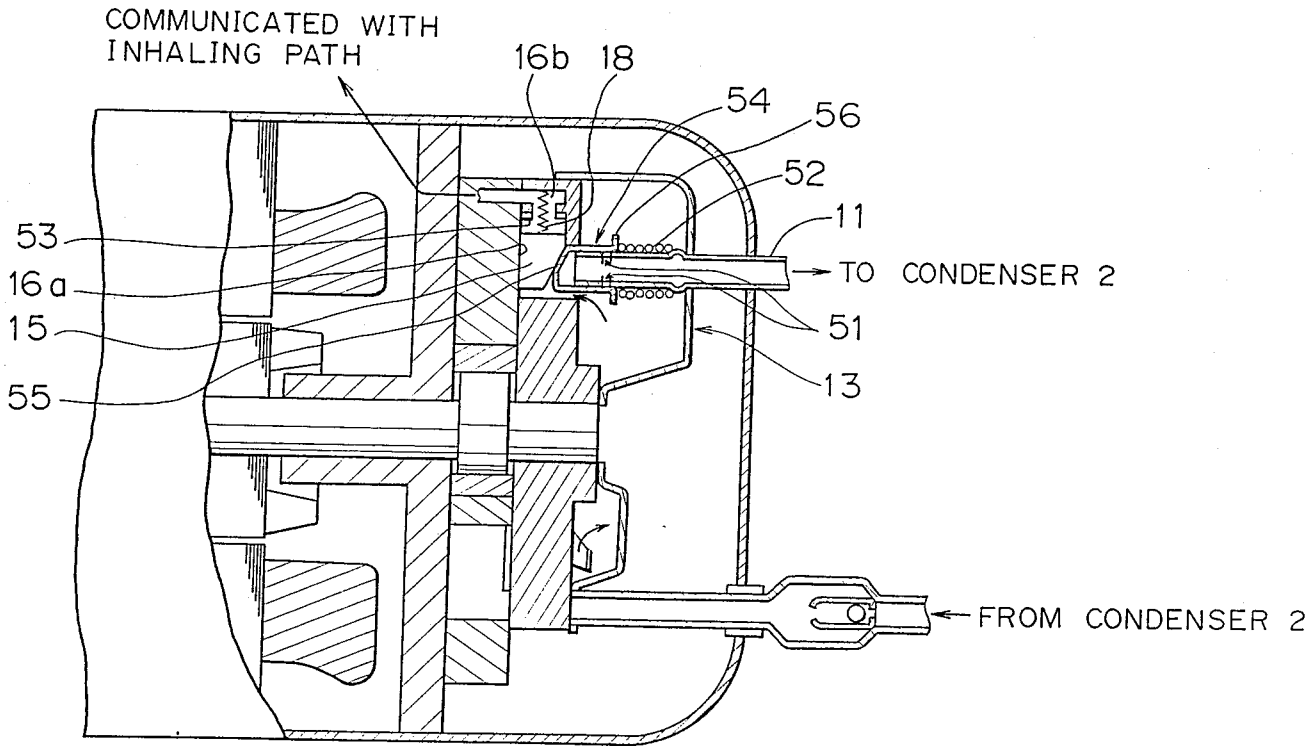
FIG. 4 is a sectional view of another embodiment according to the invenion

FIG. 4 shows another embodiment in which a control valve is positioned at an intermediate section of the exhaust pipe 11. A cap 55 is slidably mounted on one end of the exhaust pipe and is urged at a flange portion 56 by a compressed spring 52. Thus the cap 54 is in pressure contact with the valve body 15 at an inclined surface 55. When the compressor starts operating, the pressure in the muffler 13 increases and pushes up the valve body 15 causing the cap 54 to be moved to the left by the spring 52. The cap is moved until its end portion in pressure contact with the spring is translated past exhaust holes 51 that are provided at intermediate position of the exhaust pipe 11. Then the valve body 15 abuts the seal material 53. The seal material 53 also serves as a stopper against the valve body 15.

As soon as the exhaust holes 51 are exposed, the refrigerant in the muffler is exhausted into the exhaust pipe 11.

When the compressor becomes inoperative, the valve body is pushed down by the resultant force of the spring 18 and the pressure of the inhaling path, thereby moving the cap 54 to the right against the spring 52. When the flange portion 56 of the cap 54 is translated past the exhaust holes 51, the exhaust holes are closed by the cap 54.

Modification

In the previous embodiment, the valve body 15 was urged by the spring force. Alternatively, this spring 18 may be omitted if the sliding direction of the valve 15 is selected vertical. In this case, when the compressor 1 halts the resultant force of the pressure in the closed case 7 and the weight of the valve body 15 overcomes the internal pressure of the muffler 13 and causes the valve body 15 to move downwardly, thus closing the communication hole 19.

As the refrigerant gas is not exhausted into the closed case 7, the overall temperature of the compressor can be maintained low enough while it is in operation.

Further, as the check valve and the control valve are incorporated in the compressor, the refrigerant circuit can be constructed easily and inexpensively, thus a variety of effects such as increased reliability, performance and so on can be expected.

What is claimed is:

1. A rotary type compressing apparatus wherein a rolling piston type compression element and an electrically-powered drive element for driving the compression element are mounted in closed case constructed of a high-pressure vessel, characterized in that a check valve is provided in a refrigerant gas inhalation path of the compressing apparatus, and there are provided in a gas exhaust path of the compressing apparatus:

an exhaust valve positioned at an outlet of the compression element;

a muffler forming a space which encloses said exhaust valve;

an exhaust pipe having one end open to the inside of said muffler; and a control valve positioned at an inlet section of the exhaust pipe, said control valve including a valve body biased to a closed position when said compressor is inoperative and movable by the pressure of refrigerant gas in said muffler to an open position providing fluid communication between said muffler and said exhaust pipe when the pressure of refrigerant gas in the muffler exceeds a predetermined pressure after the compressor becomes operative;

wherein valve controlling operations of said control valve are performed by the pressure difference between the pressure of refrigerant gas in said muffler applied to said valve body of said control valve and the force resulting from the combination of external pressure applied to said valve body and a spring force applied thereto.

2. A rotary type compressing apparatus wherein a rolling piston type compression element and an electrically-powered drive element for driving the compression element are mounted in a closed case constructed of a high-pressure vessel, characterized in that a check valve is provided in a gas inhalation unit of the compressing apparatus, and there are provided in a gas exhaust path of the compressing apparatus:

an exhaust valve positioned adjacent an outlet of the compression element;

a muffler forming a space which surrounds said exhaust valve;

an exhaust pipe having one end open to the inside of said muffler; and a control valve positioned in an intermediate section of the exhaust pipe, said control valve including a valve body biased to a closed position when said compressor is inoperative and movable by the pressure of refrigerant gas in said muffler to an open position providing fluid communication between said muffler and said exhaust pipe when the pressure of refrigerant gas in the muffler exceeds a predetermined pressure after the compressor becomes operative;

wherein valve controlling operations of said control valve are performed by the pressure difference between the pressure of refrigerant gas in said muffler applied to said valve body of said control valve and the force resulting from the combination of external pressure applied to said valve body and a spring force applied thereto.

3. A rotary type compressing apparatus as claimed in any one of the preceding claims 1 and 2, wherein said control valve is part of the assembly of said compression element, and said control valve comprises:

a valve body receiving space provided within said assembly and having a passage which communicates with said muffler; and a slider valve body slidably received within said valve body receiving space, said slider valve body being adapted to open said one end of the exhaust pipe when the compression element is in operation and said refrigerant gas in said muffler is exhausted into said valve body receiving space through said passage and to close said one end of the exhaust pipe when the compression element is not in operation.

* * * * *